US006678470B1

(12) United States Patent
Hoshino

(10) Patent No.: US 6,678,470 B1
(45) Date of Patent: Jan. 13, 2004

(54) ELECTRIC HEATING DEVICE FOR FLUID FOOD MATERIAL

(75) Inventor: Hiroshi Hoshino, Tsuchiura (JP)

(73) Assignee: Frontier Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/256,406

(22) Filed: Sep. 27, 2002

(51) Int. Cl.[7] ..... H05B 3/60
(52) U.S. Cl. ..... 392/322; 392/311
(58) Field of Search ..... 392/311, 312, 392/313, 314, 317, 318, 319, 320, 321, 322

(56) References Cited

U.S. PATENT DOCUMENTS 1,319,315 A * 10/1919 Whelan ..... 392/314
3,925,638 A * 12/1975 Scataloni ..... 392/320
5,279,213 A * 1/1994 Miyahara ..... 99/358

FOREIGN PATENT DOCUMENTS

JP 07039320 2/1995

* cited by examiner

*Primary Examiner*—Thor Campbell
(74) *Attorney, Agent, or Firm*—McCormick, Paulding & Huber LLP

(57) ABSTRACT

Disclosed is an electric heating device for heating a fluid food material, for example, a liquid food material with high viscosity such as mayonnaise or the like, and a solid-liquid mixed food material such as a mixture of tea powder, coffee powder or the like and water, in which a solid and a liquid are mixed. The heating device includes a cylindrical container body having the bottom end thereof and containing the fluid food material. A cylindrical outer electrode is mounted in this container body, and an inner electrode, having an outer circumferential surface opposite to the inner circumferential surface of the outer electrode, is arranged at the center of the container body. An electric power is supplied from a power supply to the inner electrode and the outer electrode, and an electric current flows through the food material injected in the container body, whereby the food material is heated by the Joule heat. In heating the food material, the inner electrode is relatively rotated relative to the container body. Therefore, the food material flows in a circumferential direction in the container body due to its viscosity, and thus the adhesion of the food material to the electrode can be prevented.

9 Claims, 10 Drawing Sheets

ELECTRIC HEATING DEVICE FOR FLUID FOOD MATERIAL

BACKGROUND OF THE INVENTION

The present invention relates to an electric heating device suitable for the heating of fluid food materials, for example, liquid food materials with high viscosity such as mayonnaise, fruit sauce, miso (fermented soybean paste) or the like; mixtures obtained by mixing water with tea powder, coffee powder, herb powder, powder of chicken bones used to make soup stock, or the like; and solid-liquid mixed food materials in which a solid and a liquid are mixed, such as a jam with fruit pieces or the like.

It is well known that food materials are in many cases heated for the purpose of sterilization and processing during the production of the food materials. Recently, in the production of various kinds of drinks or soups or the like, powders of tea, coffee, chicken bones or the like and liquid such as water or the like are mixed and the mixture has been heated in order to extract essential ingredients from the powders of tea or the like.

As a method of heating a food material, in recent years, an electric heating method of carrying electricity through the food material to generate heat by the use of electric resistance of the food material itself, namely, a Joule heating method has been paid attention to. So, using such an electric heating method has been tried also concerning the fluid food material such as a liquid food material and a solid-liquid mixed food material and the like.

As a conventional device for use in the electric heating of the fluid food material, there is a device having a cubic or rectangular container in which a pair of electrodes is provided so as to be opposite to each other on the inner surfaces thereof. So, electricity is carried through the food material between the pair of electrodes in the container, and the electric heating device becomes a batch type. If a food material with high viscosity is heated in such a device, since natural convection hardly occurs in the container, it is impossible to uniformly heat the food material because natural convection is difficult to create in the container. For its solution, it is also thought to provide rotatable stirring blades in the container to stir the food material during the electric heating. In this case, however, the four corner portions of the square container become dead spaces, and the food material at and around the portions is not sufficiently stirred. Accordingly, it is difficult to uniformly heat the food material.

If the container is formed in a cylindrical shape, the dead spaces at the stirring can be eliminated. In this case, however, the pair of electrodes opposite to each other are formed in a curved shape along the inner circumferential surface of the container, and so the distance between the central portions of the pair of electrodes differs from that between the edge portions of the pair of electrodes. As a result, the current density distribution at the time of the electric heating also becomes non-uniform, and thus it is impossible to uniformly heat the food material.

In addition, as a device for the continuous electric heating of the fluid food material, as disclosed in Japanese Patent Publication No. 2793473, the device is of such a type that ring-shaped electrodes are provided in a pipe line at predetermined intervals. Also, a device is put into practical use, in which electricity is carried between the upper ring-shaped electrode and the lower ring-shaped electrode during the continuously flow of the fluid food material into the pipe line and in which the food material is continuously heated by carrying electricity. However, it is apt to be difficult to continuously flow the food material with high viscosity and the solid-liquid mixed food material into the pipe line. Generally, for continuously flowing the fluid food material into the pipe line, the fluid food material contained in a hopper is compressed and transported by a pump. However, the pump must output high power in the case of using the food material with high viscosity, and the bridge phenomenon of a solid occurs in a hopper in the case of the solid-liquid mixed food material, which makes it impossible to carry the solid therein.

In the case where a continuously electric heating device is used for the extraction of the essential ingredients of tea or the like, the powder of tea leaf and water are mixed and the mixture is continuously compressed and transported. However, since the electric heating for a long time of 20 to 30 minutes or more than 30 minutes is required for such extraction and the length of the pipe line must be increased for performing the long-time electric heating, the size of the heating device is inevitably increased.

SUMMARY OF THE INVENTION

Therefore, with respect to the food material with high viscosity and the solid-liquid mixed food material, it is indispensable to apply the batch-type electric heating device. However, as described above, in the batch-type electric heating device, there have arisen problems of the aspects of the uniform heating, the spark occurrence, the burnt deposit of the food material, and the like.

An object of the present invention is to provide a batch-type electric heating device for heating a liquid food material with high viscosity and a solid-liquid mixed food material in which a solid and a liquid are mixed.

Another object of the present invention is to provide an electric heating device capable of uniformly heating the food material in the container without producing sparks and burnt deposit of the food material.

Another object of the present invention is to provide an electric heating device capable of heating the food material for a long time, like the case of the production of an extract.

An electric heating device of the present invention is a device for heating a fluid food material by Joule heat generated by carrying a current through the fluid food material, and comprises: a cylindrical container body for containing the fluid food material, an opening being provided at the upper end of the container body and a bottom wall being provided at the lower end thereof; a cylindrical outer electrode incorporated in said container body; an inner electrode arranged at the center portion of said container body and having an outer circumferential surface which is a cylindrical surface facing to said outer electrode; a power supply for supplying power to said inner electrode and said outer electrode; and a driving means for relatively rotating said inner electrode relative to said outer electrode, wherein the fluid food material is heated by carrying the current from said inner electrode and said outer electrode while said inner electrode is relatively rotated relative to said outer electrode. In the present invention, the fluid food material with high viscosity and the solid-liquid mixed food material in which a solid and a liquid are mixed are contacted smoothly and in the rotational direction thereof to the inner electrode and the outer electrode by relatively rotating the inner electrode and the outer electrode. Therefore, it is possible to prevent the adhesion of the burnt deposit of the food material to the electrode surface and the occurrence of the scales. In addition, it is also possible to perform the long-time heating of the food material so that the ingredients in the solid substance are extracted into the liquid.

In the electric heating device of the present invention, said container body is fixed and said inner electrode is rotated.

In the electric heating device of the present invention, said inner electrode is fixed and said container body is rotated.

In the electric heating device of the present invention, both of said inner electrode and said container body are rotatably driven, and the rotational directions of said inner electrode and said container body are reverse to each other.

In the electric heating device of the present invention, the device further comprises an electrode plate functioning as an intermediate electrode, the electrode plate being opposed to said outer electrode and extending in an axial direction and being attached to and electrically connected to said inner electrode. By providing the intermediate electrode to the inner electrode, it is possible to increase the surface area of the electrode including the inner electrode and facing to the outer electrode. Therefore, the conduction efficiency can be enhanced.

In the electric heating device of the present invention, the device further comprises a scraper attached to said inner electrode and slidably contacting to the inner circumferential surface of said outer electrode. By providing the scraper to the inner electrode, it is possible to prevent the adhesion of the food material to the inner circumferential surface of the outer electrode.

In the electric heating device of the present invention, the device further comprises a stirring member attached to said inner electrode and stirring the food material contained in said container body. By providing the stirring member to the inner electrode, the food material in the container body is sufficiently stirred, and thus it is possible to heat the food material at uniform temperature as a whole.

In the electric heating device of the present invention, said container body includes an outer container and a conductive container incorporated in the outer container to form said outer electrode, and a medium path through which a heating medium for preliminarily heating said outer electrode or a cooling medium for cooling said outer electrode flows is formed between said outer container and said outer electrode. By forming the medium path in the container body, it is possible to perform the preliminary heating of the container body and to prevent the overheating of the container body.

In the electric heating device of the present invention, a cooling medium path is formed in said inner electrode. By forming the cooling medium path in the inner electrode, it is possible to prevent the overheating of the inner electrode.

DESCRIPTIONS OF THE PREFERRED EMBODIMENTS

Figure 1:
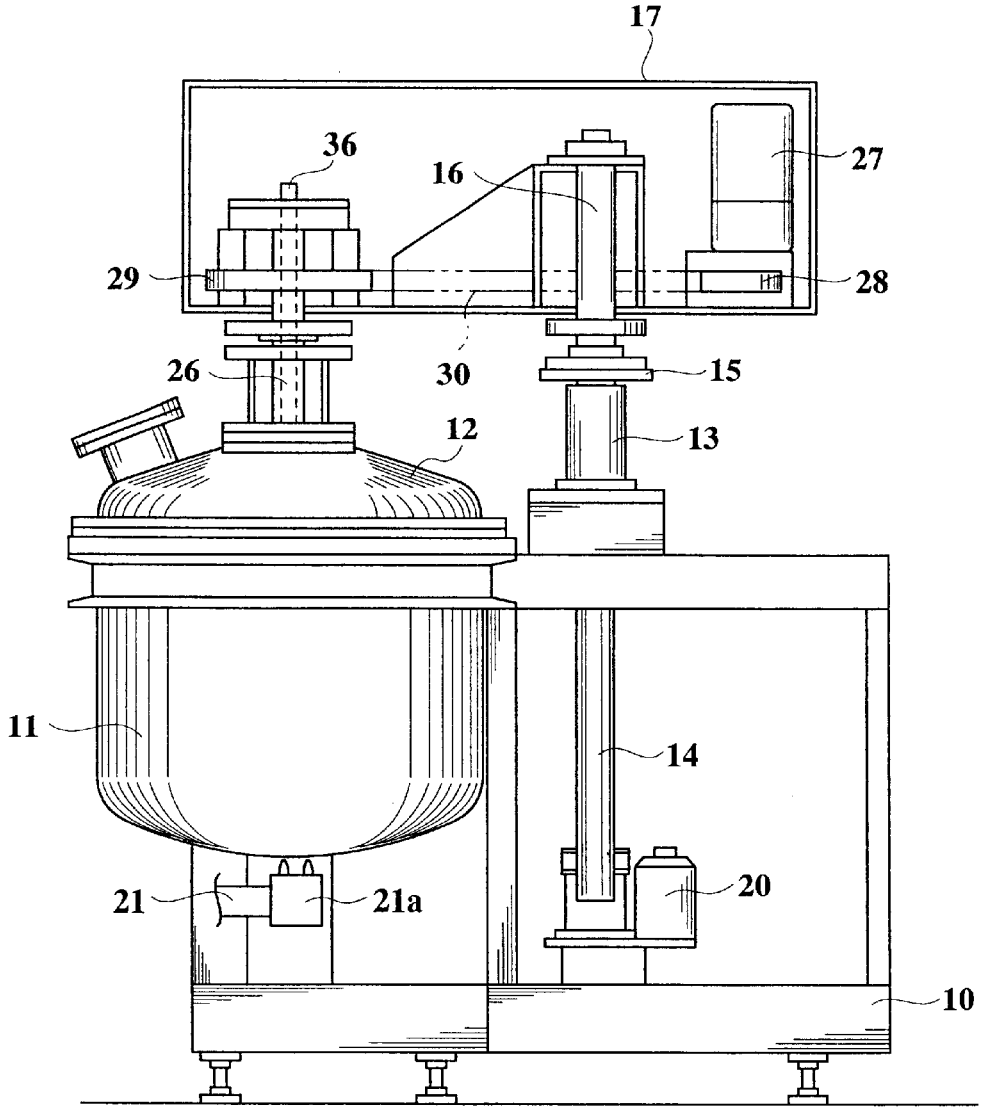
FIG. 1 is a front view, partially broken away, of an electric heating device.
Figure 2:
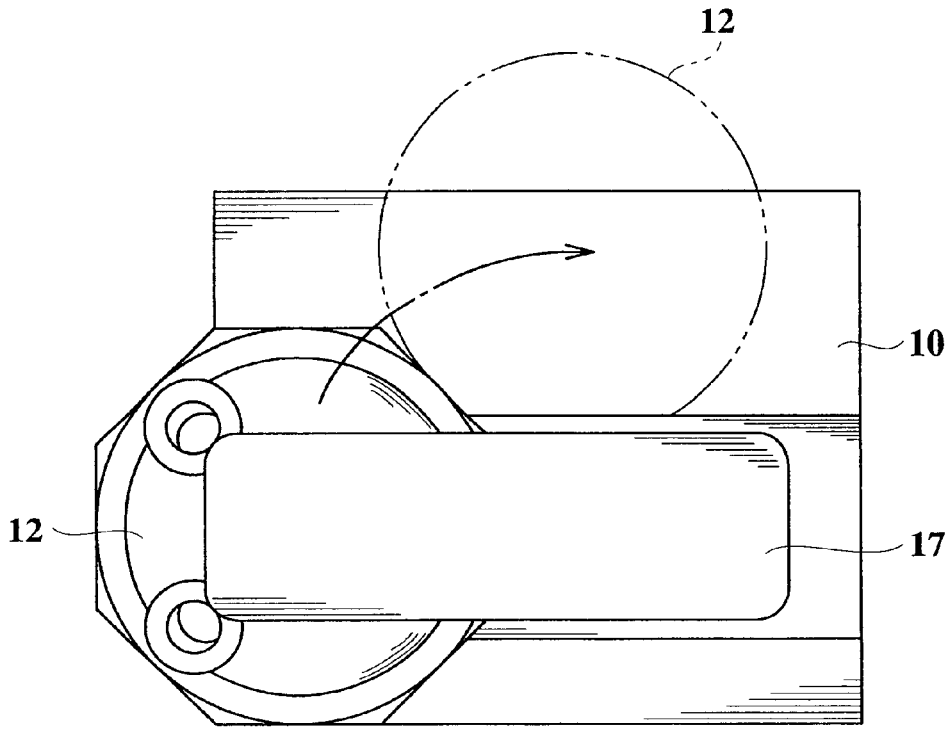
FIG. 2 is a plan view of FIG. 1.
Figure 3:
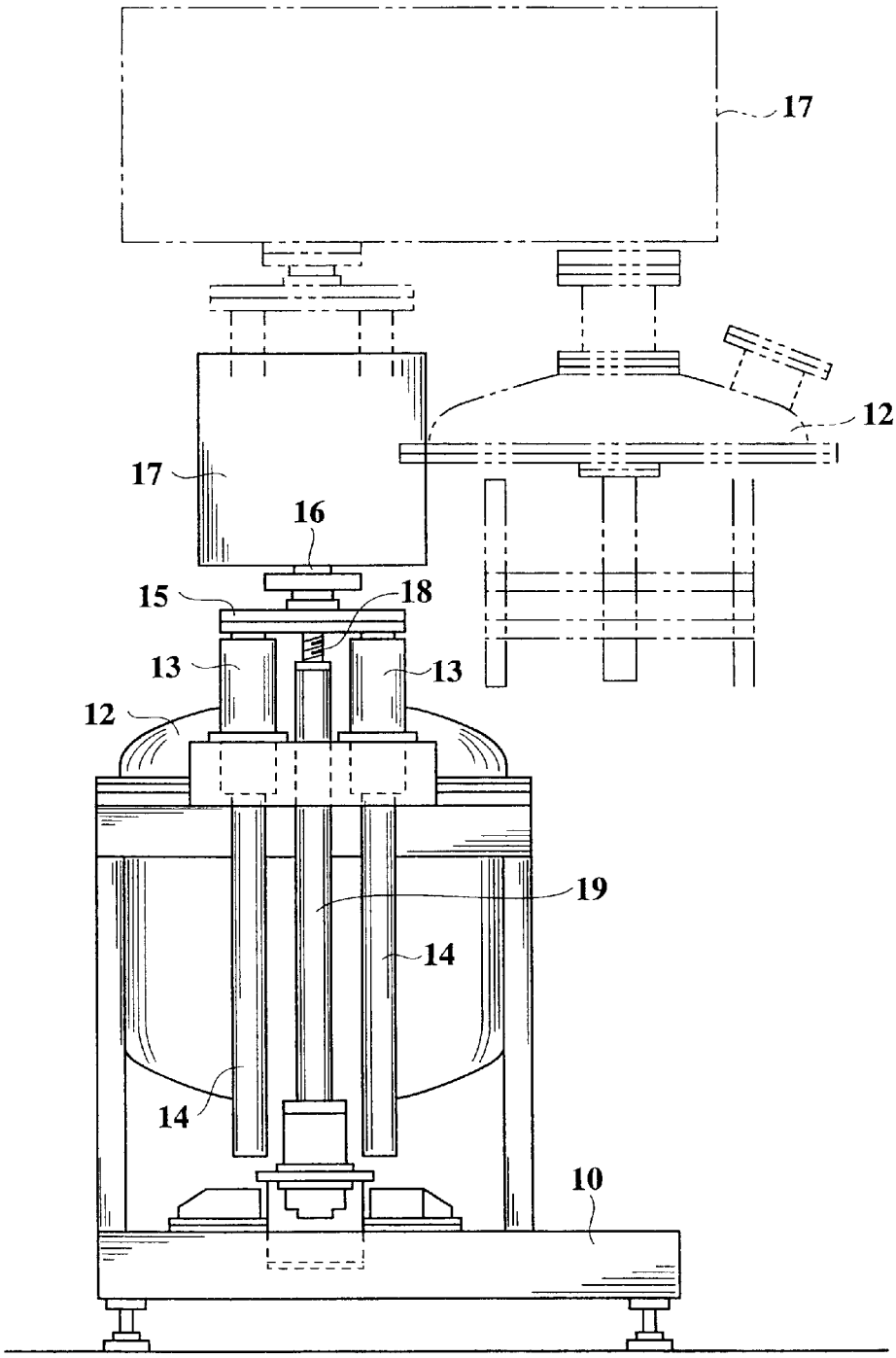
FIG. 3 is a right side view of FIG. 1.

As shown in FIGS. 1 to 3, this electric heating device is provided with a support frame 10, and a tank body or a container body 11 is fixed to the support frame 10. The container body 11 has an upper end portion with an opening, such that a lid member 12 is detachably mounted to the upper end portion. In order to move the lid member 12 between a position at which the lid member 12 is attached to the container body 11 and a position at which the lid member 12 is escaped from the container body 11, as shown in FIG. 3, a vertically movable plate 15 is attached to guide rods 14, and a pivot arm 17 is mounted to a support shaft 16 attached to the vertically movable plate 15. The guide rods 14 are slidably incorporated into two sleeves 13 fixed vertically with respect to the support frame 10, and the pivot arm 17 can pivot on the support shaft 16. The lid member 12 is attached to the tip of the pivot arm 17.

For the vertical movement of the lid member 12, a lead screw shaft 18 fixed to the vertically movable plate 15 is screw-connected to a hollow rotation shaft 19, and when the hollow rotation shaft 19 is rotated by driving a vertical movement motor 20 shown in FIG. 1, the lid member 12 is vertically moved by the pivot arm 17. By pivoting the pivot arm 17 by hands when the lid member 12 reaches the upper limit position thereof, the lid member 12 is placed at an escape position represented by the dash-double dot lines in FIGS. 2 and 3.

Figure 4:
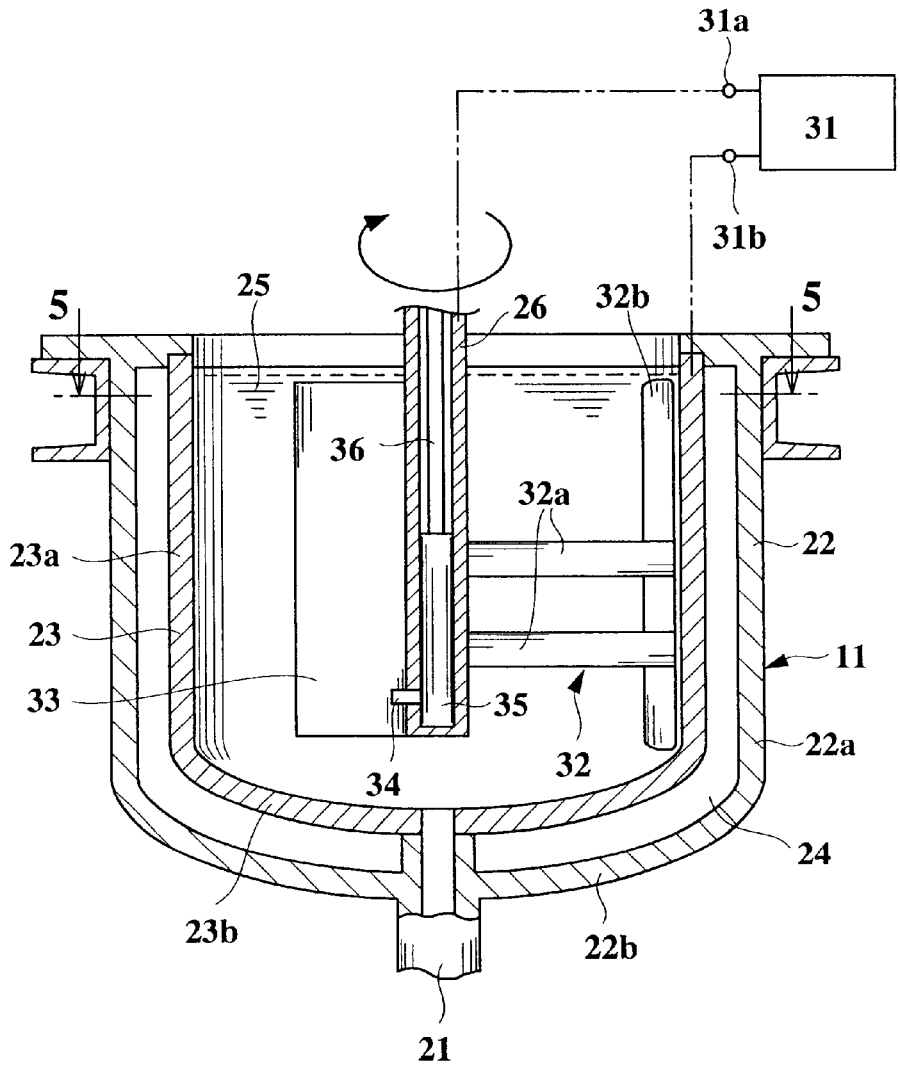
FIG. 4 is a cross-sectional view of a container body shown in FIG. 1.

As shown in FIG. 4, the container body 11 has a double structure comprising an outer container 22 and an outer electrode 23 mounted at the inside of the outer container 22. Also, a discharge pipe 21 is provided at the bottom of the container body 11 through which the food material subjected to the heating is discharged to the outside, and a pipe opening/closing valve 21*a* is provided at the discharge pipe 21 as shown in FIG. 1.

The outer container 22 has a cylindrical wall 22*a* and a bottom wall 22*b* integrally formed with the cylindrical wall 22*a*, and the outer electrode 23 has a cylindrical wall 23*a* and a bottom wall 23*b* integrally formed with the cylindrical wall 23*a*. A medium-circulating jacket 24, through which heating media such as steam or hot water or the like, or cooling media such as water or the like flows, is formed between the outer container 22 and the outer electrode 23. The outer electrode 23 is formed of a conductive material such as titanium or the like, and the outer container 22 is formed of stainless steel. A fluid food material 25, for example, a solid-liquid mixed food material such as a jam with fruit pieces or the like, and a liquid food material with high viscosity such as mayonnaise or the like, is injected into the container body 11.

A rod-shaped inner electrode 26 is rotatably mounted to the lid member 12 so as to correspond to the central axis of the container body 11 and thereby be formed in a stick shape as a whole. In order to rotate the inner electrode 26, a timing belt 30 is bridged between a pulley 28 driven by a stirring motor 27 attached to the pivot arm 17 and a pulley 29 attached to the inner electrode 26, and thus the inner electrode 26 is rotated by the motor 27.

The inner electrode 26 is electrically connected to one terminal 31*a* of a power supply 31 for electric heating, and the outer electrode 23 is electrically connected to the other terminal 31*b* of the power supply 31. This power supply 31 is designed to supply high frequency power to the respective electrodes. However, it is also possible to supply the commercial AC power thereto.

By applying voltage between the inner electrode 26 and the outer electrode 23, with the fluid food material 25 being injected in the container body 11, an electric current flows through the fluid food material 25 in the container body 11, and the fluid food material 25 generates heat by the electric resistance thereof and so the temperature thereof rises. Thus, the electric heating by the use of the Joule heat is performed. By rotating the inner electrode 26 during the electric heating, the fluid food material 25 is rotated and becomes fluid wholly over the container body 11 and thereby is stirred, so that the occurrence of the local overheating and/or insufficient heating can be prevented. As a result, the fluid food material 25 can be heated uniformly as a whole.

Since the distance between the inner electrode 26 and the outer electrode 23 is uniform relative to the whole of a circumferential direction, a carried current flows uniformly all over the circumference thereof, which contributes to the uniform heating of the food material 25. When the central position of the inner electrode 26 deviates, the distance between the electrodes becomes non-uniform relative the whole of the circumferential direction. However, since the inner electrode 26 is rotated, the uneven current distribution can be corrected with the passage of time and it is possible to uniformly heat the food material 25 as a whole. Thus, the strict setting of the position of the inner electrode 26 is unnecessary.

Since the container body 11 has a cylindrical shape as a whole, the food material 25 is forced to circulate in the container body 11 due to its viscosity by rotating the inner electrode 26. Therefore, no dead space exists at the time of stirring and flowing the food material, and the uniform heating can be performed as a whole. Even when a fluid food material with high viscosity, such as a mixture of a solid and a liquid or the like, is heated as the food material 25, it can be entirely stirred and flown. Therefore, the uniform heating can be achieved. In addition, in order to extract the ingredients from a solid substance of tea leaf or the like, even in the case where the solid substance is dispersed in a liquid and the mixture is heated for a long time, the heating can be performed without trouble.

A scraper 32 made of an electrically insulating material such as a synthetic resin or the like is attached to the inner electrode 26 in order to remove scales adhered to the inner circumferential surface of the container body 11 during the stirring. This scraper 32 has a plurality of support rods 32*a* fixed to the inner electrode 26 and extending in a horizontal direction, and a blade 32*b* vertically extending along the inner circumferential surface of the container body 11 and slidably contacting to the inner circumferential surface. The blade 32*b* is fixed to each tip of the support rods 32*a*.

This scraper 32 is rotated with the rotation of the inner electrode 26, whereby the blade 32*b* slides on the inner circumferential surface of the outer electrode 23. Thus, the blade 32*b* scrapes off the burnt deposit of the fluid food material 25 produced by the spark, and scrapes off the roots of the scales produced by the precipitation and the coagulation and the like of the solid substance and adhered to the inner circumferential surface of the outer electrode 23. By doing so, the scales can be prevented from growing. The scraper 32 rotates together with the inner electrode 26, thereby promoting the stirring of the fluid food material 25 in the container body 11. As a result, the food material 25 is heated at a more uniform temperature as a whole.

A stirring blade 33 is attached to the inner electrode 26 to vertically move the fluid food material 25 in the container body 11. The stirring blade 33 attached to the inner electrode 26 is curved in a horizontal direction and is slanted in the vertical direction. The outside of the curved surface of the stirring blade 33 faces a front side relative to the rotational direction of the inner electrode 26. When the stirring blade 33 is rotated by the rotation of the inner electrode 26, the food material 25 vertically moves in the container body 11 and also moves toward the inner surface of the container body 11. As a result, the food material 25 is heated at a more uniform temperature as a whole.

To measure the temperature of the food material 25, a temperature sensor 34 is attached to the inner electrode 26. A fixed rod 36, provided with a conduction terminal electrically connected to a conduction terminal mounted on an end surface of a sensor holder 35, is incorporated in the inner electrode 26, and the tip of the fixed rod 36 is protruded into the pivot arm 17 as shown in FIG. 1. Therefore, the signal from the temperature sensor 34 is sent from an end portion of the fixed rod 36 to an external control circuit.

Figure 5:
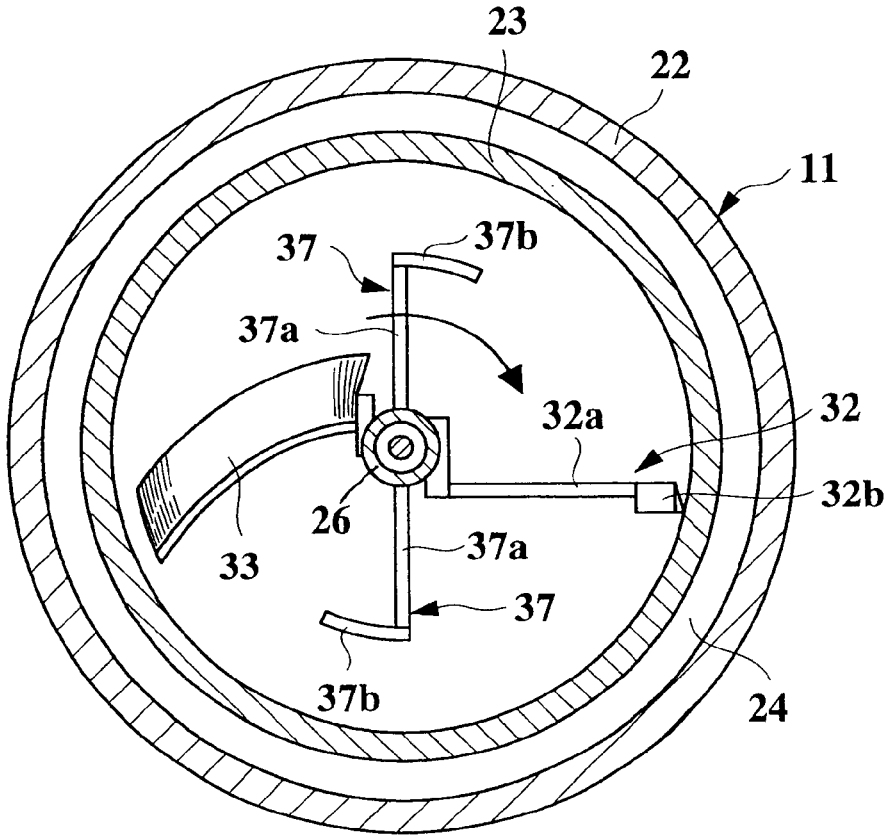
FIG. 5 is a cross-sectional view taken along the line 5—5 of FIG. 4.

As shown in FIG. 5, two intermediate electrodes 37 each made of a conductive material such as titanium or the like are attached to the inner electrode 26. Each intermediate electrode 37 has a plurality of support rods 37*a* fixed to the inner electrode 26 and extending in a horizontal direction, and an electrode plate 37*b* vertically extending along the inner circumferential surface of the container body 11 and arranged apart from the inner circumferential surface. The electrode plate 37*b* is fixed to each tip of the support rods 37*a*. Since the intermediate electrodes 37 are attached to the inner electrode 26, each intermediate electrode 37 has the same polarity as that of the inner electrode 26, so that the electric current flows between the outer electrode 23 and the inner electrode 26 and the electric current also flows between the intermediate electrode 37 and the outer electrode 23. Therefore, it is possible to increase each area of the inner electrode 26 and the intermediate electrode 37 which face to the outer electrode 23.

In heating the food material 25, the container body 11 is subjected to the preliminary heating by supplying steam or hot water or the like to the medium-circulating jacket 24. By supplying, to the inner electrode 26 and the outer electrode 23, an electric power from the power supply 31 after the preliminary heating, the electricity is carried through the food material 25. When the container body 11 is overheated by the electric heating, the temperature in the outer electrode 23 can be prevented from rising excessively by flowing the cooling medium such as water or the like into the medium-circulating jacket 24. If the temperature of the outer electrode 23 is excessively increased, then the fluid food material 25 is burned to produce scales thereon and sparks may occur at burnt positions during the electric heating. Due to the occurrence of sparks, the electricity-carrying condition thereof becomes unstable, which causes the unstable heating. As a result, the quality and the taste of the food material are often inferior. However, it is possible to prevent the occurrence of such cases by cooling the outer electrode 23. Note that it is also possible to flow the cooling medium through the inner electrode 26.

Figure 6:
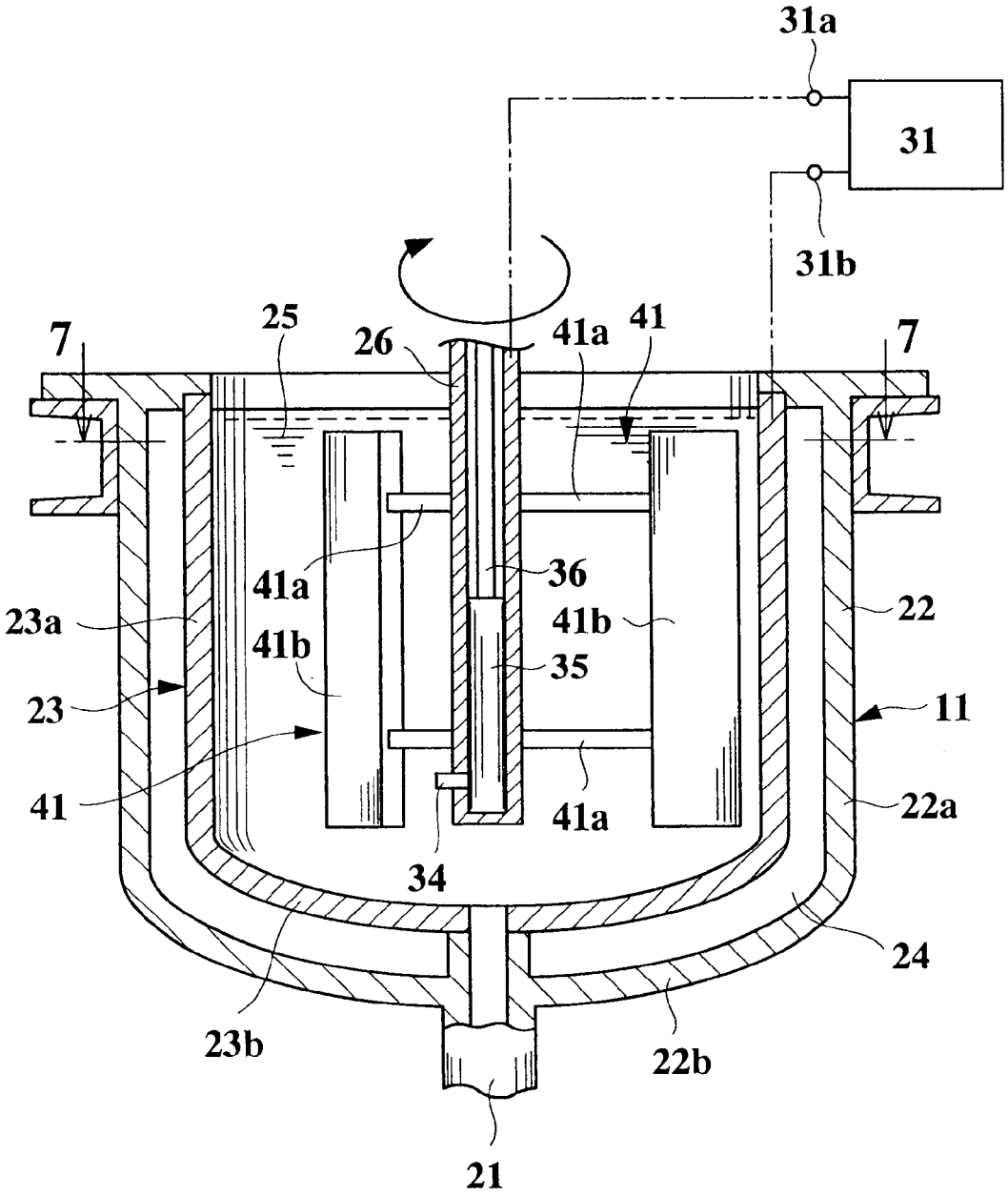
FIG. 6 is a cross-sectional view showing a modified example of the electric heating device.
Figure 7:
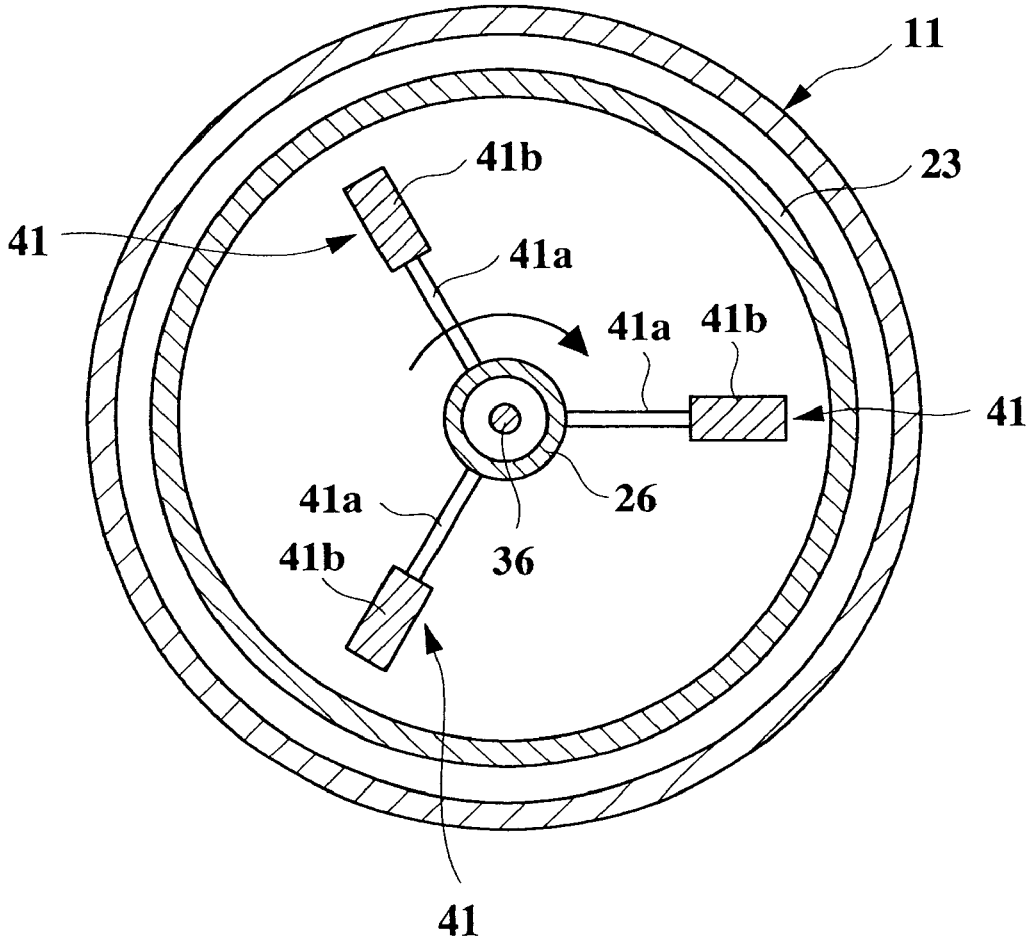
FIG. 7 is a cross-sectional view taken along the line 7—7 of FIG. 6.

In the electric heating device shown in FIGS. 6 and 7, three stirring members 41 are attached to the inner electrode 26. Each of the stirring members 41 has a plurality of support rods 41*a* fixed to the inner electrode 26 and extending in the horizontal direction, and a stirring blade 41*b* vertically extending along the inner circumferential surface of the container body 11. The stirring blade 41*b* is fixed to the tip of the support rod 41*a*. If each stirring blade 41*b* is formed of a conductive material and is electrically connected to the inner electrode 26, each stirring blade 41*b* can function as an intermediate electrode.

Figure 8:
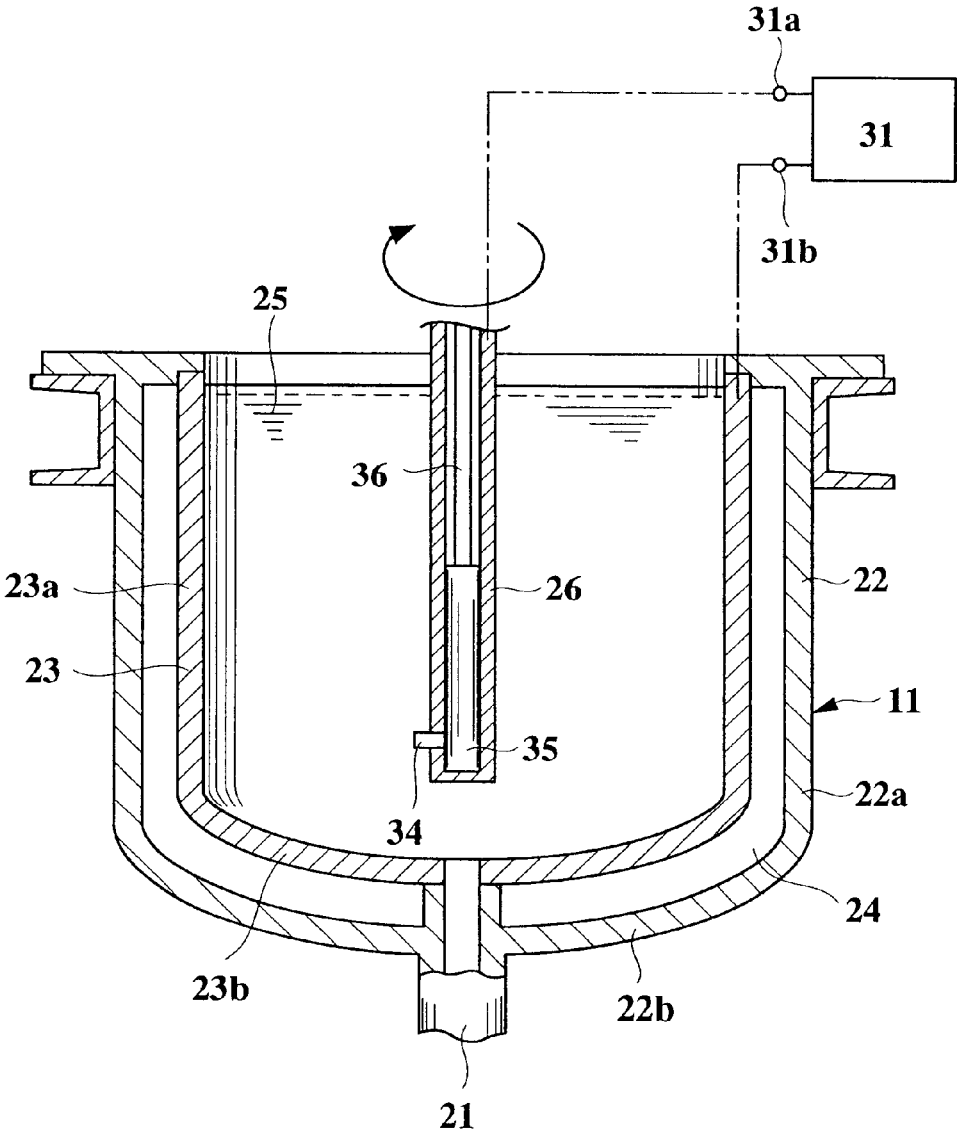
FIG. 8 is a cross-sectional view showing a modified example of the electric heating device.

In the electric heating device shown in FIG. 8, the scrapers 32, the stirring blade 33 and the intermediate electrodes 37 shown in FIGS. 4 and 5 are not provided to the inner electrode 26. Also in this case, the food material 25 is circulated and stirred in the container body 11 due to its viscosity by rotating the inner electrode 26. In the respective electric heating devices shown in FIGS. 6 to 8, components common to those shown in FIGS. 4 and 5 are denoted by the same reference numerals.

As described above, in the case where the container body 11 is fixed to the support frame 10, since the lid member 12 can be attached to the container body 11, the inside of the container can be made a compressed condition or a decompressed condition. Of course, it is also possible to set the inside of the container to be atmospheric pressure. However, when the heating is performed under the atmospheric pressure, it is unnecessary to use the lid member 12.

Figure 9:
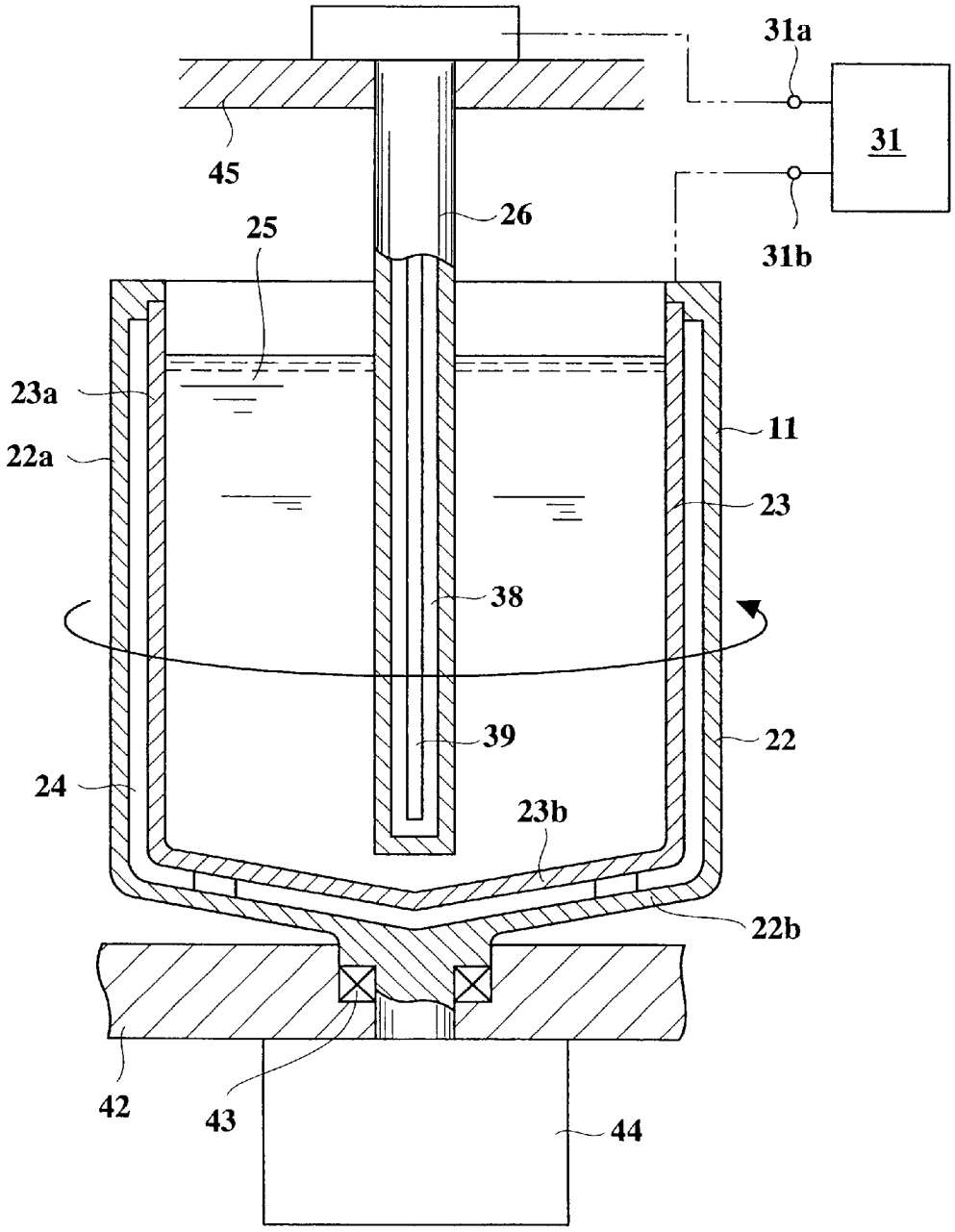
FIG. 9 is a cross-sectional view showing a modified example of the electric heating device.

In the electric heating device shown in FIG. 9, it is constituted such that the lid member 12 cannot be attached to the container body 11. In this case, the container body 11 is rotatably supported by a support table 42 via a bearing 43, and the container body 11 is rotatably driven by a rotation motor 44. Meanwhile, the inner electrode 26 is fixed to a support member 45 and is not rotated.

Figure 10:
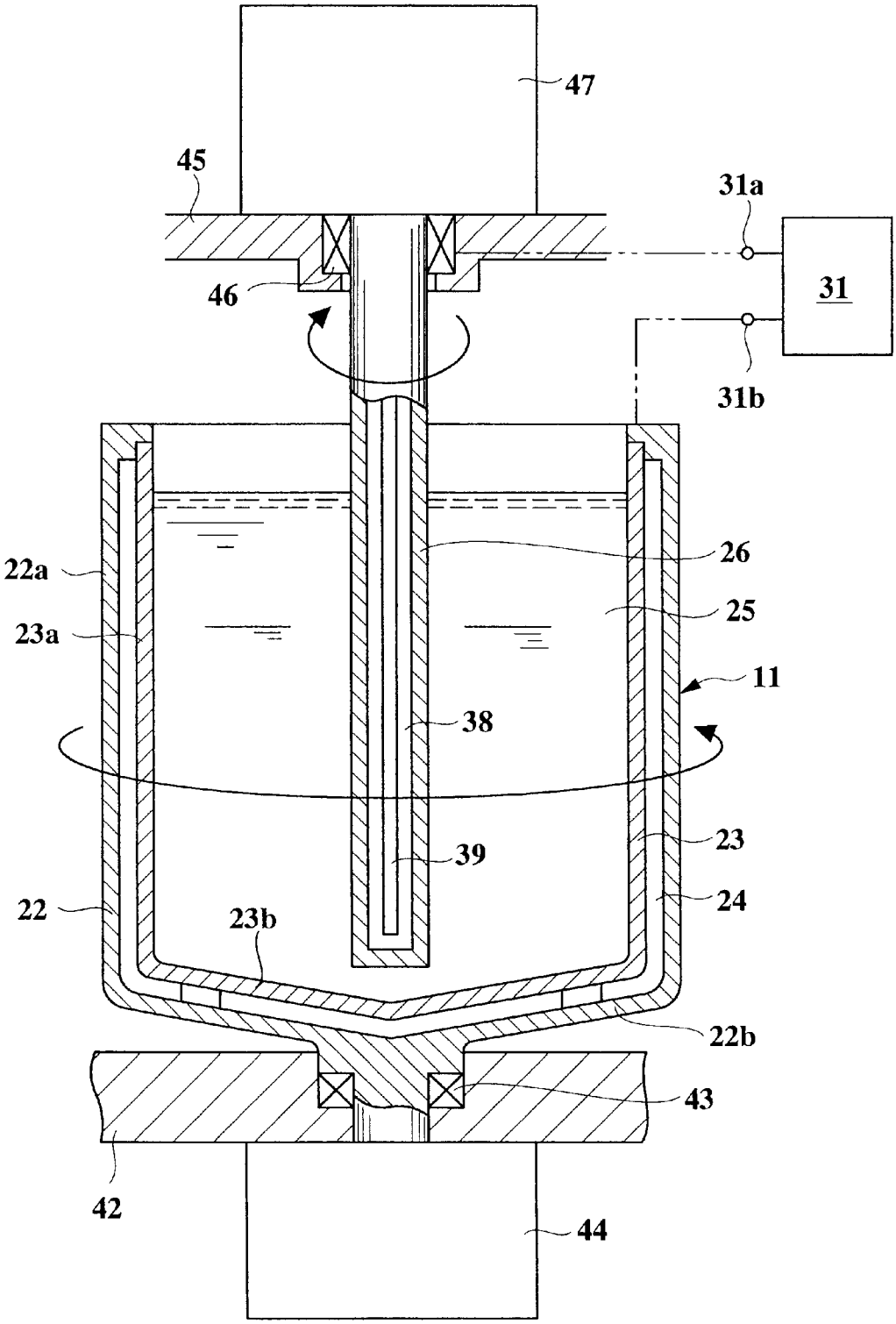
FIG. 10 is a cross-sectional view showing a modified example of the electric heating device.

In the electric heating device shown in FIG. 10, the container body 11 is rotatably driven in the same manner as that shown in FIG. 9, and also the inner electrode 26 is rotatably attached to the support member 45 via a bearing 46 and is rotatably driven by the rotation motor 44. The rotational direction of the inner electrode 26 is reverse to that of the container body 11. In the electric heating device shown in FIG. 10, components common to those shown in FIG. 9 are denoted by the same reference numerals.

In the electric heating devices shown in FIGS. 9 and 10, a medium path 38 is provided in the inner electrode 26, and a cooling medium or a heating medium is supplied to the path 38 from a supply pipe 39 incorporated in the inner electrode 26.

What is claimed is:

1. An electric heating device for heating a fluid food material by Joule heat generated by carrying a current through the fluid food material, the device comprising:

a cylindrical container body for containing the fluid food material, an opening being provided at the upper end of the container body and a bottom wall being provided at the lower end thereof;

a cylindrical outer electrode incorporated in said container body;

an inner electrode arranged at the center portion of said container body and having an outer circumferential surface which is a cylindrical surface facing to said outer electrode;

a power supply for supplying power to said inner electrode and said outer electrode; and a driving means for relatively rotating said inner electrode relative to said outer electrode, wherein the fluid food material is heated by carrying the current from said inner electrode and said outer electrode while said inner electrode is relatively rotated relative to said outer electrode.

2. The electric heating device according to claim 1, wherein said container body is fixed and said inner electrode is rotated.

3. The electric heating device according to claim 1, wherein said inner electrode is fixed and said container body is rotated.

4. The electric heating device according to claim 1, wherein both of said inner electrode and said container body are rotatably driven, and the rotational directions of said inner electrode and said container body are reverse to each other.

5. The electric heating device according to claim 1, further comprising an electrode plate functioning as an intermediate electrode, the electrode plate being opposed to said outer electrode and extending in an axial direction and being attached to and electrically connected to said inner electrode.

6. The electric heating device according to claim 1, further comprising a scraper attached to said inner electrode and slidably contacting to the inner circumferential surface of said outer electrode.

7. The electric heating device according to claim 1, further comprising a stirring member attached to said inner electrode and stirring the food material contained in said container body.

8. The electric heating device according to claim 1, wherein said container body includes an outer container and a conductive container incorporated in the outer container to form said outer electrode, and a medium path through which a heating medium for preliminarily heating said outer electrode or a cooling medium for cooling said outer electrode flows is formed between said outer container and said outer electrode.

9. The electric heating device according to claim 1, wherein a cooling medium path is formed in said inner electrode.

* * * * *